US005653471A

United States Patent [19]

Koehn

[11] Patent Number: 5,653,471

[45] Date of Patent: Aug. 5, 1997

[54] NESTED BOOK ASSEMBLY

[75] Inventor: Annalee Koehn, Chicago, Ill.

[73] Assignee: R.R. Donnelley & Sons Company, Chicago, Ill.

[21] Appl. No.: 659,135

[22] Filed: Jun. 4, 1996

[51] Int. Cl.[6] ..... B42D 1/00

[52] U.S. Cl. ..... 281/16; 281/15.1; 281/29; 281/37; 281/51; 446/100

[58] Field of Search ..... 281/16, 17, 37, 281/31, 29, 15.1, 51; 402/4, 70, 73; 434/259, 406, 167; 446/147, 100; 273/157 R

[56] References Cited

U.S. PATENT DOCUMENTS

| | | | |
|---|---|---|---|
| 841,266 | 1/1907 | Northup . | |
| 959,754 | 5/1910 | Kennedy | 434/259 |
| 1,153,503 | 9/1915 | Kuhmarker | 281/37 |
| 1,263,307 | 4/1918 | Barler | 446/100 |
| 1,565,901 | 12/1925 | Brandt . | |
| 1,638,277 | 8/1927 | Smith . | |
| 1,835,909 | 12/1931 | Shoemaker, Jr. . | |
| 2,235,801 | 3/1941 | Herlihy | 31/1 |
| 2,548,043 | 4/1951 | Muhlhauser | 281/42 |
| 2,652,635 | 9/1953 | Conger | 35/9 |
| 2,717,165 | 9/1955 | Shapiro | 281/16 |
| 2,723,465 | 11/1955 | Silverstein | 35/35 |
| 2,812,183 | 11/1957 | Schiff | 273/155 |
| 2,839,843 | 6/1958 | Keyko | 35/35 |
| 2,946,137 | 7/1960 | Worth | 35/35 |
| 3,094,791 | 6/1963 | Thiebes | 35/26 |
| 3,471,962 | 10/1969 | Klein | 46/22 |
| 3,491,196 | 1/1970 | Stein | 434/167 |
| 3,815,920 | 6/1974 | Carter et al. | 273/157 R |
| 4,176,473 | 12/1979 | Rae | 35/35 |
| 4,294,469 | 10/1981 | Errichiello | 281/29 |
| 4,487,585 | 12/1984 | Goldwasser | 434/259 |
| 4,597,743 | 7/1986 | Becker et al. | 446/71 |
| 4,640,512 | 2/1987 | Burke | 273/157 R |
| 4,819,963 | 4/1989 | Wolski | 281/15.1 |
| 4,877,269 | 10/1989 | Callaghan et al. | 283/40 |
| 4,909,542 | 3/1990 | Marks | 281/15.1 |
| 5,165,894 | 11/1992 | Reasoner et al. | 434/345 |
| 5,213,507 | 5/1993 | Ozrovitz | 434/178 |
| 5,575,658 | 11/1996 | Barnard | 434/406 |

FOREIGN PATENT DOCUMENTS

| | | | |
|---|---|---|---|
| 1043872 | 12/1993 | France | 281/17 |
| 23009 | 10/1902 | United Kingdom | 281/37 |

*Primary Examiner*—M. Rachuba
*Assistant Examiner*—Gregory Andoll
*Attorney, Agent, or Firm*—Marshall, O'Toole, Gerstein, Murray & Borun

[57] ABSTRACT

A nested book assembly for a child is composed of a first book having a front cover, a back cover, and a plurality of pages attached between the two covers and a second book having a front cover, a back cover, and a plurality of pages attached between the two covers. The second book has a shape which substantially corresponds to the shape of a cavity formed in the front cover of the first book so that the second book may be frictionally retained within the cavity. The nested book assembly may include one or more puzzle pieces which are frictionally retained within one or more cavities formed in one or more of the books, the overall shape of each of the puzzle pieces substantially corresponding to the shape of a respective one of the cavities in which the puzzle pieces may be frictionally retained. The shape of the books and the puzzle pieces may represent a different portion of a person's face so that when the books and the puzzle pieces are frictionally retained within their respective cavities, the book assembly appears to resemble a person's face.

19 Claims, 4 Drawing Sheets

NESTED BOOK ASSEMBLY

BACKGROUND OF THE INVENTION

The invention is directed to a nested book assembly having a plurality of books which nest together on top of each other. U.S. Pat. No. 5,165,894 to Reasoner, et al. discloses an educational device in which a plurality of books are removably supported within a book tray. The book tray has a plurality of recesses formed therein, each of the recesses having a shape which generally corresponds to a respective letter of the alphabet, and each of the books has an overall shape which corresponds to the shape of one of the recesses formed in the book tray. In an embodiment shown in FIG. 2 of the Reasoner, et al. patent, the book tray is flat. In column 3, at lines 6–7, Reasoner, et al. state that "the tray 70 may be non-planar (e.g., hemispheric, pyramid-shaped or the like)."

SUMMARY OF THE INVENTION

The invention is directed to a nested book assembly for a child. The nested book assembly includes a first book having a front cover, a back cover, and a plurality of pages attached between the two covers and a second book having a front cover, a back cover, and a plurality of pages attached between the two covers. The second book has a shape which substantially corresponds to the shape of a cavity formed in the front cover of the first book so that the second book may be retained within the cavity.

The nested book assembly may include one or more puzzle pieces which are frictionally retained within one or more cavities formed in one or more of the books, the overall shape of each of the puzzle pieces substantially corresponding to the shape of a respective one of the cavities in which the puzzle pieces are frictionally retained. The shape of the books and the puzzle pieces may represent a different portion of a person's face so that when the books and the puzzle pieces are retained within their respective cavities, the book assembly resembles a person's face.

Each of the books in the nested book assembly may have a rectangular shape, and each of the books may be rotationally offset with respect to the other books when the books are disposed within their respective cavities.

These and other features and advantages of the present invention will be apparent to those of ordinary skill in the art in view of the detailed description of the preferred embodiments, which is made with reference to the drawings, a brief description of which is provided below.

DETAILED DESCRIPTION OF THE PREFERRED EMBODIMENTS

Figure 1:
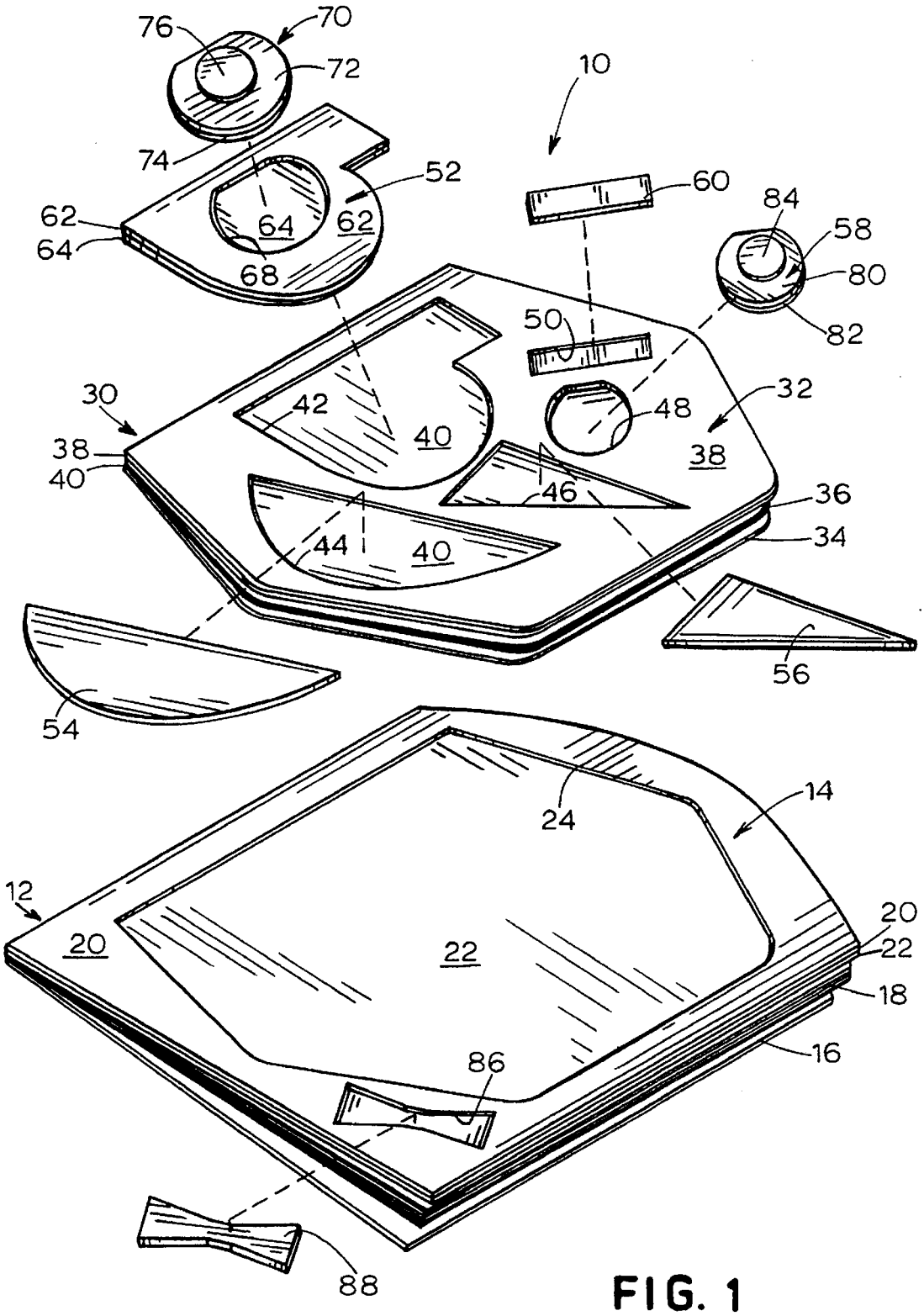
FIG. 1 is an exploded perspective view of a first embodiment of a nested book assembly in accordance with the invention.

FIG. 1 is an exploded perspective view of a first embodiment of a nested book assembly 10 designed for a child.

Referring to FIG. 1, the nested book assembly 10 includes a base book 12 having a front cover 14, a back cover 16, and a plurality of pages 18 disposed between the covers 14, 16. The front cover 14 is composed of two relatively thick cardboard sheets 20, 22 adhesively bonded or otherwise connected together. Each of the sheets 20, 22 may be composed of double-faced corrugated board, for example. The covers 14, 16 and the pages 18 may be bound or connected together in any conventional manner.

The upper sheet 20 has a hole 24 formed therein which, together with the lower sheet 22, acts as a retaining cavity for a nesting book 30. The nesting book 30 has a front cover 32, a back cover 34 and a plurality of pages 36 disposed between the covers 32, 34. The front cover 32 is composed of two relatively thick cardboard sheets 38, 40 adhesively bonded or otherwise connected together and has a plurality of holes 42, 44, 46, 48, 50 formed therein.

Each of the holes 42–50 has a different shape, which together with the lower sheet 40, acts as a retaining cavity for one of a plurality of cardboard members 52, 54, 56, 58, 60, referred to herein as puzzle pieces. The puzzle piece 52 may be composed of a pair of relatively thick cardboard sheets 62, 64 bonded together, with a hole 68 in the sheet 62 forming a cavity in which another cardboard puzzle piece 70 may be frictionally retained. The puzzle piece 70 may be composed of two cardboard sheets 72, 74, one of which has a cavity formed therein to frictionally retain a further puzzle piece 76 therein.

The puzzle piece 58 may be composed of two cardboard sheets 80, 82, one of which has a cavity formed therein to frictionally retain a further puzzle piece 84 therein. The base book 12 may have a second cavity 86 formed therein to frictionally retain a cardboard puzzle piece 88 therein.

The shape of the book 30 corresponds to the shape of the cavity 24 so that, when the back cover 34 of the book 30 is pressed into the cavity 24, the book 30 is frictionally retained within the cavity 24 regardless of the position of the nested book assembly 10. The frictional fit of the nesting book 30 within the base book 12 may be accomplished by forming a cut along the boundary of the aperture 24 in a single sheet of cardboard to form two pieces of cardboard, a first piece of cardboard having a shape that corresponds to the sheet 20 and a second piece of cardboard having a shape that corresponds to the aperture 24. The frictional fit is then accomplished by using the second sheet of cardboard as the back cover 40 of the nesting book 30. The frictional fit of the puzzle pieces 52, 58, 70 can be accomplished in the same manner.

The puzzle pieces 52, 54, 56, 58, 60, 70, 76, 80, 84, 88 are preferably thicker than the depth of the cavities into which they may be inserted so that they are disposed at an elevation higher than the cardboard member in which they are disposed, thus allowing them to be readily removed from the cavities by the child. If any puzzle pieces are formed of two cardboard sheets bonded together, the frictional fit between them and their respective cavities may be accomplished in the manner described above.

Figure 2:
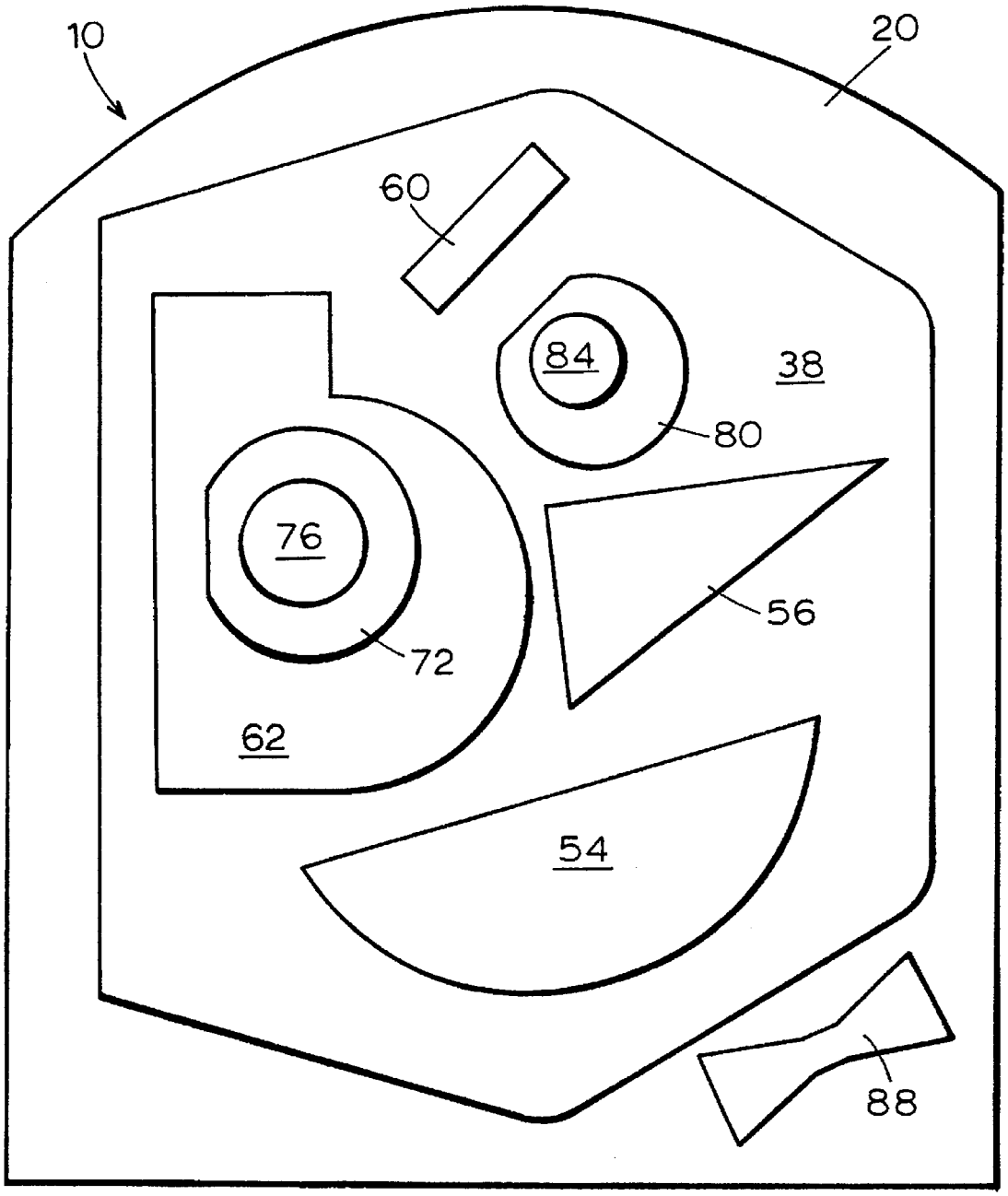
FIG. 2 is a top view of the nested book assembly of FIG. 1.

FIG. 2 is a top view of the nested book assembly 10 of FIG. 1 when the book 30 is disposed in the cavity 24 and when the puzzle pieces 52, 54, 56, 58, 60, 70, 76, 84, 88 are disposed within their respective cavities. As shown in FIG. 2, a number of the puzzle pieces are shaped to correspond to various features of a person's face, with the piece 54 representing a mouth, the piece 56 representing a nose, the puzzle pieces 70, 76, 80, 84 representing eyes, and the puzzle piece 60 representing an eyebrow. The puzzle piece 88 has a shape which corresponds to a bow tie. The books 12, 30 and the puzzle pieces 52, 54, 56, 58, 60, 70, 76, 84, 88 are preferably provided with different colors to form an aesthetically pleasing book assembly.

Figure 3:
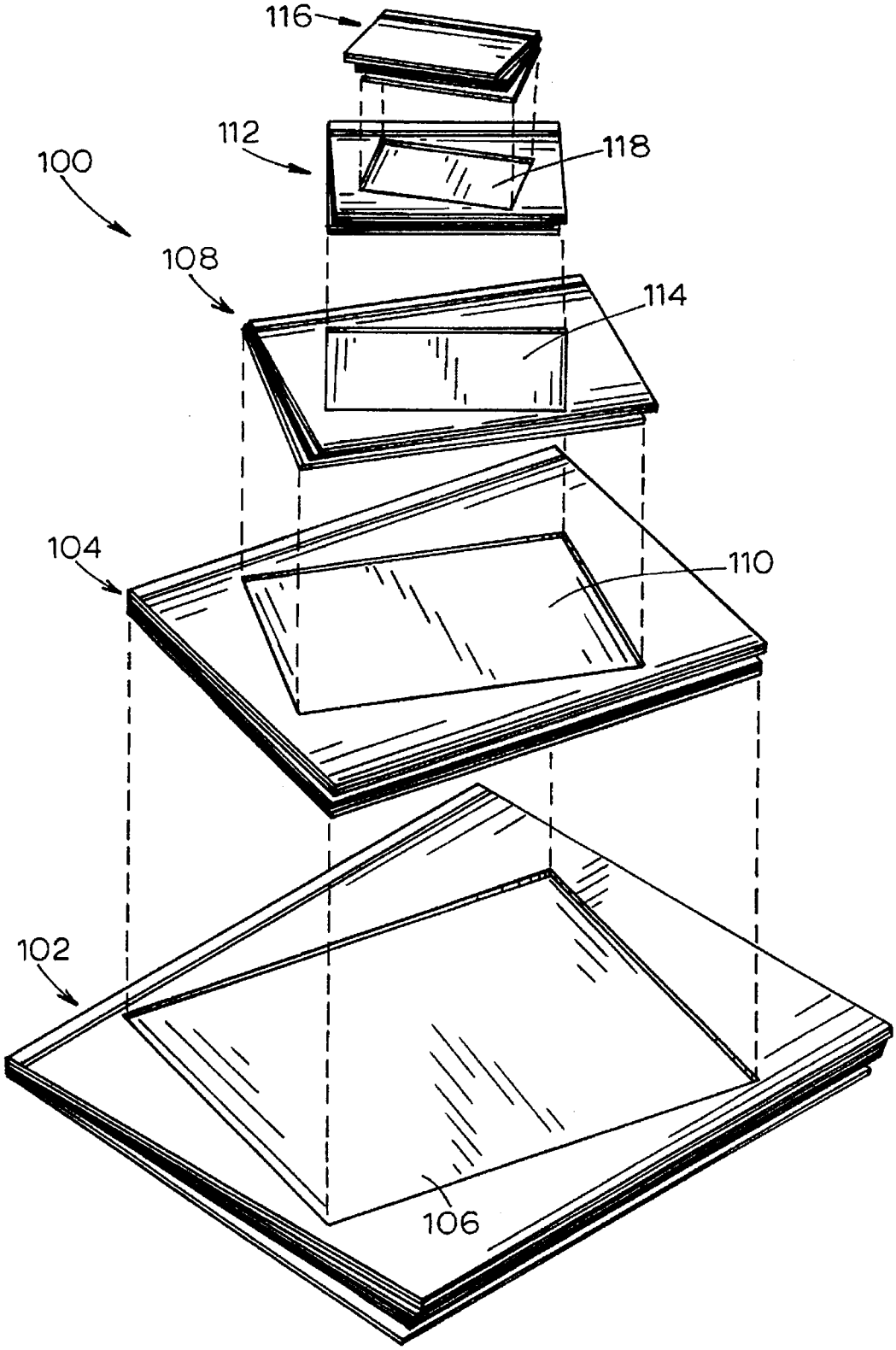
FIG. 3 is an exploded perspective view of a second embodiment of a nested book assembly in accordance with the invention.

FIG. 3 is an exploded perspective view of a second embodiment of a nested book assembly 100. The book assembly 100 includes a bottom book 102, a first nesting book 104 which is adapted to be frictionally retained within a cavity 106 formed in the book 102, a second nesting book 108 which is adapted to be frictionally retained within a cavity 110 formed in the book 104, a third nesting book 112 which is adapted to be frictionally retained within a cavity 114 formed in the book 108, and a fourth nesting book 116 which is adapted to be frictionally retained within a cavity 118 formed in the book 112.

The bottom book 102 and each of the nesting books 104, 108, 112, 116 includes a front cover, a back cover and a plurality of pages disposed between the two covers. The front cover of each of the books may be formed of two sheets of corrugated board bonded together, with each of the cavities being formed by a hole in the upper sheet of the cover.

Figure 4:
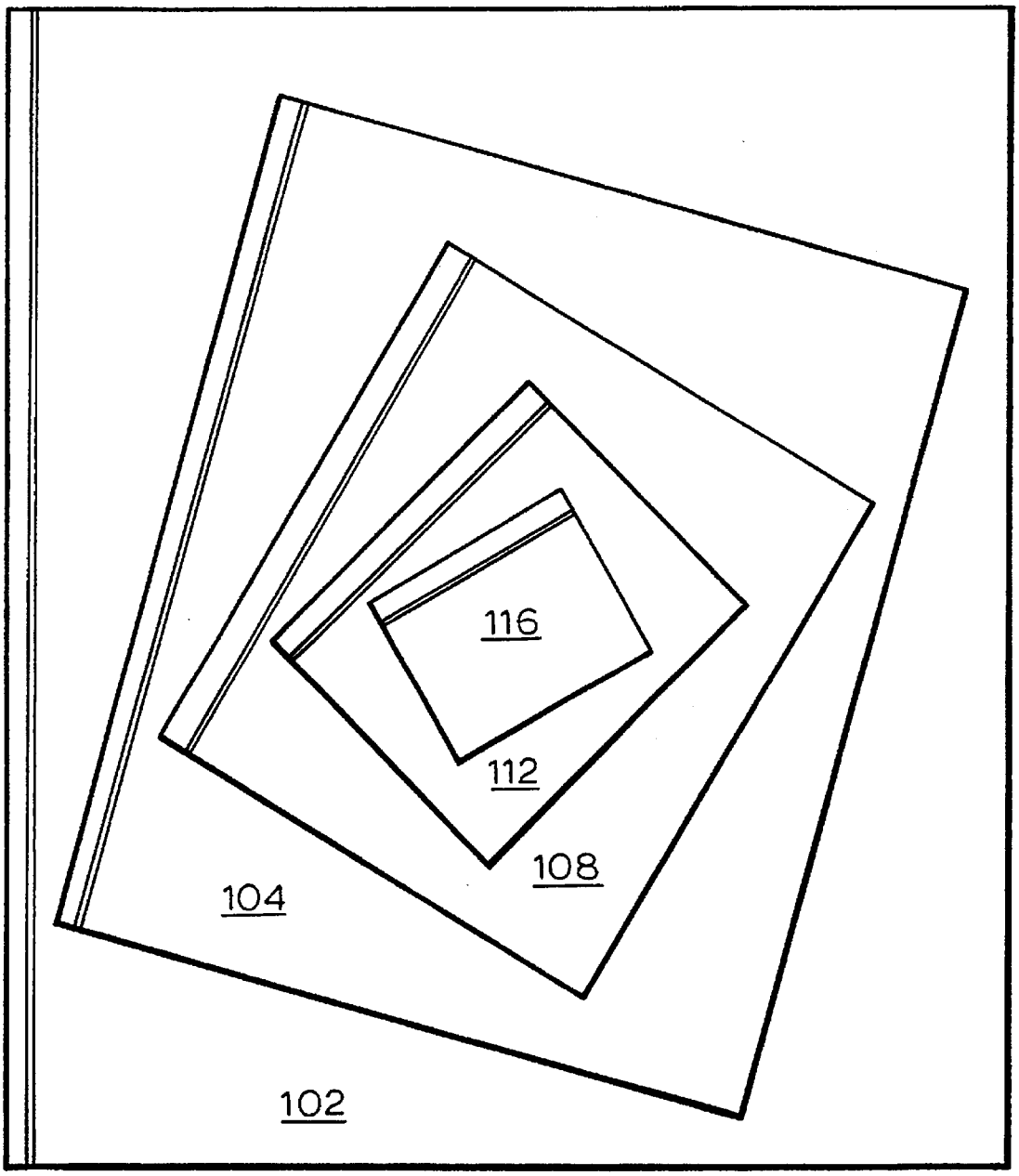
FIG. 4 is a top view of the nested book assembly of FIG. 3.

FIG. 4 is a top view of the nested book assembly 100 of FIG. 3 when each of the nesting books 104, 108, 112, 116 is frictionally retained within its respective cavity. As shown in FIG. 4, each of the books 102, 104, 108, 112, 116 has a rectangular shape, and the cavity formed in each of the books 102, 104, 108, 112 is rotationally offset.

Modifications and alternative embodiments of the invention will be apparent to those skilled in the art in view of the foregoing description. This description is to be construed as illustrative only, and is for the purpose of teaching those skilled in the art the best mode of carrying out the invention. The details of the structure and method may be varied substantially without departing from the spirit of the invention, and the exclusive use of all modifications which come within the scope of the appended claims is reserved.

What is claimed is:

1. A nested book assembly, comprising:

a first book having a front cover, a back cover, and a plurality of pages attached between the front cover and said back cover, said front cover having a cavity with a shape formed therein;

a second book having a front cover, a back cover, and a plurality of pages attached between said front cover of said second book and said back cover of said second book, said second book having a shape substantially corresponding to said shape of said cavity formed in said first book so that said second book may be frictionally retained within said cavity, said front cover of said second book having a first cavity with a shape formed therein and a second cavity with a shape formed therein;

a first puzzle piece having a shape substantially corresponding to said shape of said first cavity formed in said second book so that said first puzzle piece may be frictionally retained within said first cavity;

a second puzzle piece having a shape substantially corresponding to said shape of said second cavity formed in said second book so that said second puzzle piece may be frictionally retained within said second cavity, said second puzzle piece having a cavity with a shape formed therein; and a third puzzle piece having a shape substantially corresponding to said shape of said cavity formed in said second puzzle piece so that said third puzzle piece may be frictionally retained within said cavity formed in said second puzzle piece.

2. An assembly as defined in claim 1 wherein each of said cavities has a different shape.

3. An assembly as defined in claim 1 wherein each of said puzzle pieces has a shape which represents a different portion of a person's face.

4. An assembly as defined in claim 1 wherein each of said puzzle pieces has a different color.

5. An assembly as defined in claim 1 wherein said cavity formed in said second puzzle piece is formed in an upper surface of said second puzzle piece.

6. An assembly as defined in claim 1 wherein said front cover of said first book has a second cavity with a shape formed therein, said assembly additionally comprising a fourth puzzle piece having a shape substantially corresponding to said shape of said second cavity formed in said front cover of said first book so that said fourth puzzle piece may be frictionally retained within said cavity formed in said front cover of said first book.

7. A nested book assembly, comprising:

a first book having a front cover, a back cover, and a plurality of pages attached between said front cover and said back cover, said front cover of said first book having a cavity with a shape formed therein;

a second book having a front cover, a back cover, and a plurality of pages attached between said front cover of said second book and said back cover of said second book, said second book having a shape substantially corresponding to said shape of said cavity so that said second book may be frictionally retained within said cavity, said front cover of said second book having a cavity with a shape formed therein; and a third book having a front cover, a back cover, and a plurality of pages attached between said front cover of said third book and said back cover of said third book, said third book having a shape substantially corresponding to said shape of said cavity formed in said second book so that said third book may be frictionally retained within said cavity formed in said second book.

8. An assembly as defined in claim 7 wherein each of said books has a substantially rectangular shape.

9. An assembly as defined in claim 7 wherein each of said books has a substantially identical shape.

10. An assembly as defined in claim 7 wherein each of said books has a substantially identical shape and wherein one of said books is rotationally offset with respect to another of said books when said second book is disposed within said cavity formed in said front cover of said first book and when said third book is disposed within said cavity formed in said front cover of said second book.

11. A nested book assembly, comprising:

a first book having a front cover, a back cover, and a plurality of pages attached between said front cover and said back cover, said front cover of said first book having a cavity with a shape formed therein; and a second book having a front cover, a back cover, and a plurality of pages attached between said front cover of said second book and said back cover of said second book, said second book having a shape substantially corresponding to said shape of said cavity so that said second book may be frictionally retained within said cavity.

12. An assembly as defined in claim 11 wherein said first book has a second cavity with a shape formed therein, said assembly additionally comprising a puzzle piece having a shape substantially corresponding to said shape of said second cavity formed in said first book so that said puzzle piece may be frictionally retained within said second cavity.

13. An assembly as defined in claim 11 wherein said second book has a cavity with a shape formed therein, said assembly additionally comprising a puzzle piece having a shape substantially corresponding to said shape of said cavity formed in said second book so that said puzzle piece may be frictionally retained within said cavity formed in said second book.

14. An assembly as defined in claim 13 wherein said cavity formed in said second book is formed in an upper surface of said second book.

15. An assembly as defined in claim 11 wherein said first book has a second cavity with a shape formed therein and wherein said second book has a cavity with a shape formed therein, said assembly additionally comprising:

a first puzzle piece having a shape substantially corresponding to said shape of said second cavity formed in said first book so that said first puzzle piece may be frictionally retained within said second cavity; and a second puzzle piece having a shape substantially corresponding to said shape of said cavity formed in said second book so that said second puzzle piece may be frictionally retained within said cavity formed in said second book.

16. An assembly as defined in claim 11 wherein said second book has a first cavity with a shape formed therein and a second cavity with a shape formed therein, said assembly additionally comprising:

a first puzzle piece having a shape substantially corresponding to said shape of said first cavity formed in said second book so that said first puzzle piece may be frictionally retained within said first cavity formed in said second book; and a second puzzle piece having a shape substantially corresponding to said shape of said second cavity formed in said second book so that said second puzzle piece may be frictionally retained within said second cavity formed in said second book.

17. An assembly as defined in claim 16 wherein each of said cavities has a different shape.

18. An assembly as defined in claim 16 wherein each of said puzzle pieces has a shape which represents a different portion of a person's face.

19. An assembly as defined in claim 16 wherein each of said puzzle pieces has a different color.

* * * * *